US006383934B1

(12) United States Patent
Sabde et al.

(10) Patent No.: US 6,383,934 B1
(45) Date of Patent: May 7, 2002

(54) METHOD AND APPARATUS FOR CHEMICAL-MECHANICAL PLANARIZATION OF MICROELECTRONIC SUBSTRATES WITH SELECTED PLANARIZING LIQUIDS

(75) Inventors: Gundu M. Sabde; James J. Hofmann; Michael J. Joslyn; Whonchee Lee, all of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 44 days.

(21) Appl. No.: 09/652,955

(22) Filed: Aug. 31, 2000

Related U.S. Application Data

(63) Continuation-in-part of application No. 09/389,643, filed on Sep. 2, 1999.

(51) Int. Cl.[7] ..... H01L 21/00

(52) U.S. Cl. ..... 438/692; 156/345; 216/38; 216/84; 216/85; 438/693; 438/745

(58) Field of Search ..... 438/690, 691, 438/692, 693, 745, 753; 216/38, 84, 85; 156/345 LP

(56) References Cited

U.S. PATENT DOCUMENTS

| | | | |
|---|---|---|---|
| 6,028,006 | A | 2/2000 | Bawa et al. |
| 6,074,949 | A | 6/2000 | Schonauer et al. |
| 6,080,673 | A | 6/2000 | Ko et al. |
| 6,099,604 | A | 8/2000 | Sandhu et al. |
| 6,121,143 | A | 9/2000 | Meesner et al. |

*Primary Examiner*—William A. Powell
(74) *Attorney, Agent, or Firm*—Perkins Coie LLP

(57) ABSTRACT

A method and apparatus for planarizing a microelectronic substrate. In one embodiment, the method can include planarizing the microelectronic substrate with a fixed abrasive polishing pad while maintaining the pH of a planarizing liquid adjacent the polishing pad at an approximately constant level by buffering the planarizing liquid. The planarizing liquid can include ammonium hydroxide and ammonium acetate, ammonium citrate, or potassium hydrogen phthalate. In another embodiment, the planarizing liquid can have an initially high pH that has a reduced tendency to decrease during planarization. The planarizing liquid can also include agents, such as isopropyl alcohol, ammonium acetate or polyoxy ethylene ether that can increase the wetted surface area of the microelectronic substrate and/or reduce drag force imparted to the microelectronic substrate by the polishing pad.

98 Claims, 3 Drawing Sheets

METHOD AND APPARATUS FOR CHEMICAL-MECHANICAL PLANARIZATION OF MICROELECTRONIC SUBSTRATES WITH SELECTED PLANARIZING LIQUIDS

CROSS-REFERENCE TO RELATED APPLICATIONS

This application is a continuation-in-part of pending U.S. patent No. application Ser. No. 09/389,643, filed Sep. 2, 1999.

TECHNICAL FIELD

The present invention relates to selected planarizing liquids for chemical-mechanical planarization of microelectronic substrates.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic-device substrates and substrate assemblies. FIG. 1 schematically illustrates a CMP machine 10 having a platen 20. The platen 20 supports a planarizing medium 40 that can include a polishing pad 41 having a planarizing surface 42 on which a planarizing liquid 43 is disposed. The polishing pad 41 may be a conventional polishing pad made from a continuous phase matrix material (e.g., polyurethane), or it may be a new generation fixed-abrasive polishing pad made from abrasive particles fixedly dispersed in a suspension medium. The planarizing liquid 43 may be a conventional CMP slurry with abrasive particles and chemicals that remove material from the wafer, or the planarizing liquid may be a planarizing solution without abrasive particles. In most CMP applications, conventional CMP slurries are used on conventional polishing pads, and planarizing solutions without abrasive particles are used on fixed abrasive polishing pads.

The CMP machine 10 can also include an underpad 25 attached to an upper surface 22 of the platen 20 and the lower surface of the polishing pad 41. A drive assembly 26 rotates the platen 20 (as indicated by arrow A), and/or it reciprocates the platen 20 back and forth (as indicated by arrow B). Because the polishing pad 41 is attached to the underpad 25, the polishing pad 41 moves with the platen 20.

A wafer carrier 30 is positioned adjacent the polishing pad 41 and has a lower surface 32 to which a substrate 12 may be attached via suction. Alternatively, the substrate 12 may be attached to a resilient pad 34 positioned between the substrate 12 and the lower surface 32. The wafer carrier 30 may be a weighted, free-floating wafer carrier, or an actuator assembly 33 may be attached to the wafer carrier to impart axial and/or rotational motion (as indicated by arrows C and D, respectively).

To planarize the substrate 12 with the CMP machine 10, the wafer carrier 30 presses the substrate 12 face-downward against the polishing pad 41. While the face of the substrate 12 presses against the polishing pad 41, at least one of the platen 20 or the wafer carrier 30 moves relative to the other to move the substrate 12 across the planarizing surface 42. As the face of the substrate 12 moves across the planarizing surface 42, material is continuously removed from the face of the substrate 12.

CMP processes should consistently and accurately produce a uniformly planar surface on the substrate to enable precise fabrication of circuits and photo-patterns. During the fabrication of transistors, contacts, interconnects and other features, many substrates develop large "step heights" that create a highly topographic surface across the substrate. Yet, as the density of integrated circuits increases, it is necessary to have a planar substrate surface at several stages of processing the substrate because non-uniform substrate surfaces significantly increase the difficulty of forming sub-micron features. For example, it is difficult to accurately focus photo-patterns to within tolerances approaching 0.1 $\mu$m on non-uniform substrate surfaces because sub-micron photolithographic equipment generally has a very limited depth of field. Thus, CMP processes are often used to transform a topographical substrate surface into a highly uniform, planar substrate surface.

In the competitive semiconductor industry, it is also highly desirable to have a high yield in CMP processes by producing a uniformly planar surface at a desired endpoint on a substrate as quickly as possible. For example, when a conductive layer on a substrate is under-planarized in the formation of contacts or interconnects, many of these components may not be electrically isolated from one another because undesirable portions of the conductive layer may remain on the substrate over a dielectric layer. Additionally, when a substrate is over-planarized, components below the desired endpoint may be damaged or completely destroyed. Thus, to provide a high yield of operable microelectronic devices, CMP processing should quickly remove material until the desired endpoint is reached.

The planarity of the finished substrate and the yield of CMP processing is a function of several factors, one of which is the rate at which material is removed from the substrate (the "polishing rate"). Although it is desirable to have a high polishing rate to reduce the duration of each planarizing cycle, the polishing rate should be uniform across the substrate to produce a uniformly planar surface. The polishing rate should also be consistent to accurately endpoint CMP processing at a desired elevation in the substrate. The polishing rate, therefore, should be controlled to provide accurate, reproducible results.

In certain applications, the polishing rate depends on the chemical interaction between the substrate and the planarizing liquid. For example, the polishing rate can depend on the rate at which material at the surface of the substrate is hydrolyzed. The rate at which the hydrolysis reaction proceeds can be dependent on several factors, including the pH of the planarizing liquid adjacent to the substrate. In some CMP operations, the pH of the liquid can vary as the planarization process proceeds. For example, the pH can decrease as material from the substrate and the polishing pad is released into the planarizing liquid. As the pH level decreases, the polishing rate can also decrease because the rate at which the hydrolysis reaction proceeds can decrease. Furthermore, as the hydrolysis reaction rate decreases, the mechanical interaction between the polishing pad and the substrate can dominate the chemical interaction and can increase the likelihood for forming scratches in the surface of the substrate.

Another factor affecting the overall planarity of the substrate assembly is the wetted surface area of the polishing pad. If the polishing pad develops localized dry spots, the polishing pad can be more likely to scratch the substrate because the dry spots are less chemically active than the wetted regions, and therefore the mechanical interaction between the polishing pad and the substrate can dominate the chemical interaction at the dry spots, as discussed above.

One conventional approach to maintaining the pH of the planarizing liquid is to planarize a metal-containing substrate with a conventional polishing pad without fixed-abrasive particles in combination with an acidic or neutral pH slurry containing a suspension of abrasive particles and a chemical buffering agent. However, this approach has several drawbacks. For example, the acidic or neutral pH is not suitable for planarizing substrates containing certain materials, such as oxides. Furthermore, the polishing rate can be influenced by the distribution of the planarizing liquid 43 between the substrate 12 and the planarizing surface 42 of the polishing pad 41. The distribution of the planarizing liquid 43 may not be uniform across the surface of the substrate 12 because the leading edge of the substrate 12 can wipe a significant portion of the planarizing liquid 43 from the polishing pad 41 before the planarizing liquid 43 can contact the other areas of the substrate 12. The nonuniform distribution of planarizing liquid 43 under the substrate 12 can cause certain areas of the substrate 12 to have a higher polishing rate than other areas because they have more contact with the chemicals and/or abrasive particles in the planarizing liquid 43. The surface of the substrate 12 may accordingly not be uniformly planar and in extreme cases, some devices may be damaged or destroyed by CMP processing.

Another approach to the foregoing problem, disclosed in commonly assigned U.S. patent application Ser. No. 09/164,916, assigned to the assignee of the present application, is to provide a fixed abrasive polishing pad with soluble elements that are released into the planarizing liquid as the polishing pad abrades during normal operation. The soluble elements can include surfactants to increase the wetted surface area of the substrate, or a buffering agent to buffer the planarizing liquid. One potential drawback with this approach is that the combination of the planarizing liquid and the chemicals released by the soluble elements may not be compatible with the high-pH environment used to remove materials such as oxides from the substrate 12. Another potential drawback is that the release of the chemicals from the polishing pad may not occur in an entirely uniform fashion, resulting in spatial and/or temporal variations in wetted surface area and/or pH during the planarizing process.

Another drawback with some of the conventional approaches described above is that the frictional forces between the substrate 12 and the polishing pad 41 can become so high that the substrate 12 sticks to the polishing pad 41. For example, in some polishing operations (e.g., "flat CMP"), polishing continues after the surface roughness of the substrate 12 has been eliminated to reduce the thickness of the substrate 12. During flat CMP, the frictional forces between the substrate 12 and the polishing pad 41 can increase substantially due to the increase in substrate surface area contacting the polishing pad 41. The substrate 12 can accordingly stick to the polishing pad 41. When the substrate 12 sticks to the polishing pad 41, it can slip out from underneath the carrier 30, causing damage to the substrate 12 and/or the carrier 30. Furthermore, an operator must reinstall the substrate 12 in the carrier 30, increasing the time required to polish the substrate 12. Still further, it can be very difficult to accurately track the total time during which the substrate is planarized, due to the interruption in the planarizing process resulting from reinstalling the substrate 112.

SUMMARY OF THE INVENTION

The present invention is directed toward methods and apparatuses for planarizing microelectronic substrates. In one aspect of the invention, the method can include maintaining the pH of a planarizing liquid adjacent a fixed abrasive polishing pad at an approximately constant value. For example, the method can include providing a buffering agent to only a region external to the polishing pad to maintain the pH of the planarizing liquid at an approximately constant alkaline value of between approximately 9 and approximately 13. The buffering agent can be selected to include ammonium hydroxide or potassium hydroxide and at least one of ammonium acetate, ammonium citrate and potassium hydrogen phthalate. Alternatively, the buffering agent can be eliminated and the pH of the planarizing liquid can be selected to have a relatively high value, for example, at least 12.

In another aspect of the invention, the method can include engaging the microelectronic substrate with the planarizing liquid and a fixed abrasive polishing pad, moving at least one of the substrate and the polishing pad relative to the other and controlling a hydrolysis reaction at the surface of the microelectronic substrate or controlling a rate at which the microelectronic substrate scratches by providing a buffering agent to the planarizing liquid while the microelectronic substrate is engaged with the planarizing liquid. For example, removing material from the microelectronic substrate can include removing silicon dioxide from the microelectronic substrate, and controlling the hydrolysis reaction can include promoting a conversion of silicon dioxide to $Si(OH)_6^{2-}$.

In still another aspect of the invention, the method can include controlling a drag force between the microelectronic substrate and the polishing pad by selecting the planarizing liquid to include a surfactant. The method can further include removing material from all portions of the surface of the microelectronic substrate at a generally uniform rate and selecting the surfactant to include isopropyl alcohol. The isopropyl alcohol can be about 0.5% to about 2% of the weight of the planarizing liquid. In yet another aspect of this method, the planarizing liquid is a first planarizing liquid and the method further comprises selecting an amount of the surfactant in the first planarizing liquid to reduce a first polishing rate of the first planarizing liquid by no more than about 5% compared to a second polishing rate of a second planarizing liquid not having the surfactant, when the first and second planarizing liquids remove material under generally identical conditions.

A planarizing medium in accordance with still another aspect of the invention can include a fixed abrasive polishing pad and an adjacent planarizing liquid. The planarizing liquid can include at least one of ammonium acetate, polyoxy ethylene ether and isopropyl alcohol for controlling a wetted surface area of the polishing pad. Alternatively, the planarizing liquid can include from about 0.5% to about 2.0% isopropyl alcohol for controlling a friction force between the polishing pad and a microelectronic substrate. The polishing pad can have a generally circular planform shape for mounting to a generally circular platen, or the polishing pad can include an elongated flexible web configured to be wound from a first roller across a platen to a second roller.

DETAILED DESCRIPTION OF THE INVENTION

The present disclosure describes methods and apparatuses for mechanical and/or chemical-mechanical planarization of substrates used in the fabrication of microelectronic devices. Many specific details of certain embodiments of the invention are set forth in the following description and in FIGS. 2 and 3 to provide a thorough understanding of the embodiments described herein. One skilled in the art, however, will understand that the present invention may have additional embodiments, or that the invention may be practiced without several of the details described in the following description.

Figure 2:
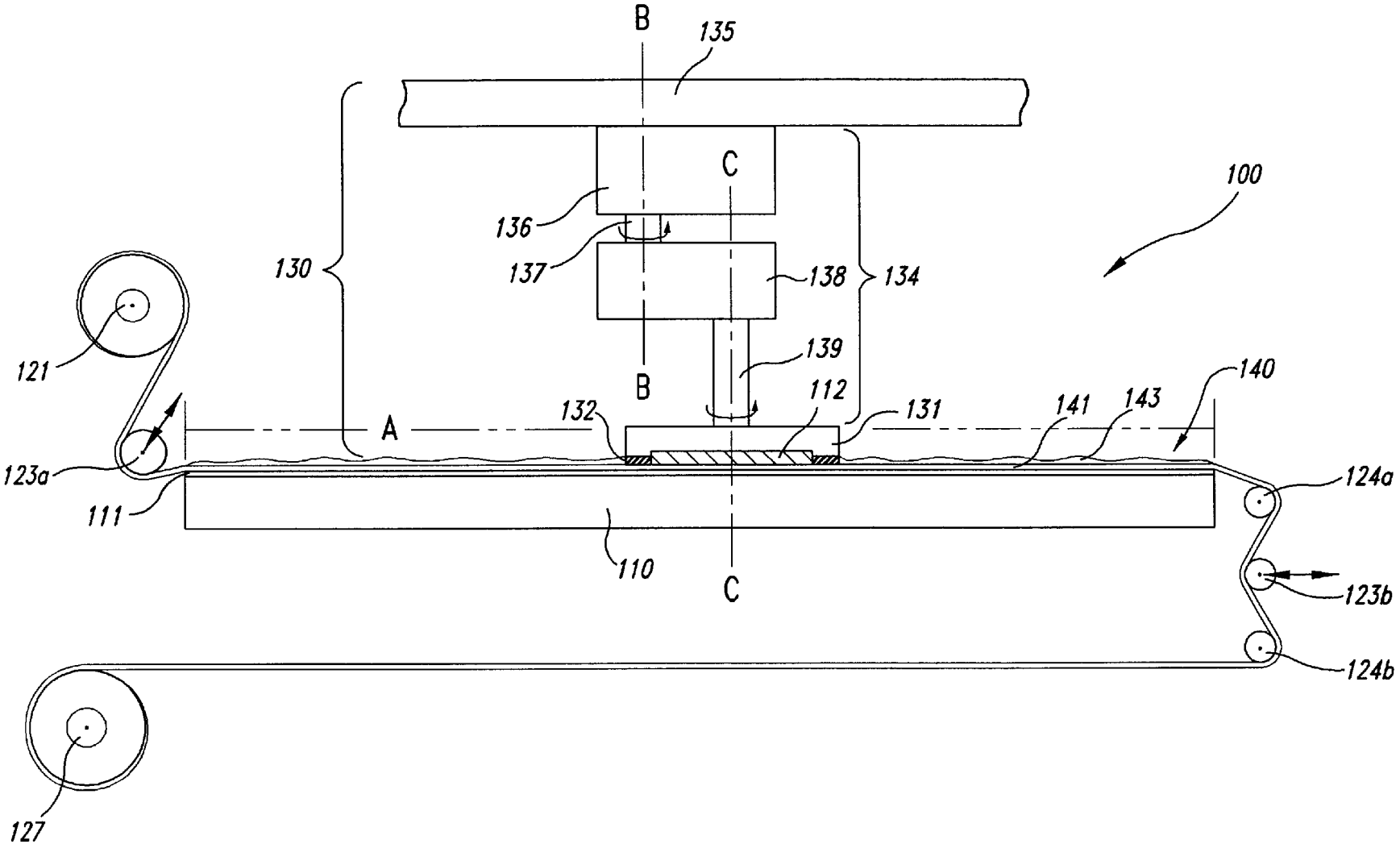
FIG. 2 is a partially schematic, partial cross-sectional side elevation view of a planarizing machine having a polishing pad and a planarizing liquid in accordance with an embodiment of the invention.

FIG. 2 is a partially schematic, partial cross-sectional side elevation view of a planarizing machine 100 having a planarizing medium 140 that includes a polishing pad 141 and a planarizing liquid 143 in accordance with one embodiment of the invention for planarizing a substrate 112. The polishing pad can include an SWR 159 pad available from 3M Company of St. Paul, Minn. The substrate 112 can include a single unit of semiconductor material, such as silicon, or a semiconductor material in combination with conductive materials, insulative materials, and/or other materials that are applied to the substrate during processing. The features and advantages of the polishing pad 141 and the planarizing liquid 143 are best understood in the context of the structure and the operation of the planarizing machine 100. Thus, the general features of the planarizing machine 100 will be described initially.

The planarizing machine 100 is a web-format planarizing machine with a support table 110 having a top-panel 111 at a workstation where an operative portion "A" of the polishing pad 141 is positioned. An example of a suitable machine 100 is a Flatland tool, available from Applied Materials, Inc. of Santa Clara, Calif. The top-panel 111 is generally a rigid plate that provides a flat, solid surface to which a particular section of the polishing pad 141 may be secured during planarization. The planarizing machine 100 also has a plurality of rollers to guide, position and hold the polishing pad 141 over the top-panel 111. In one embodiment, the rollers include a supply roller 121, first and second idler rollers 123*a* and 123*b*, first and second guide rollers 124*a* and 124*b* and a take-up roller 127. The supply roller 121 carries an unused or a pre-operative portion of the polishing pad 141, and the take-up roller 127 carries a used or post-operative portion of the polishing pad 141. Additionally, the first idler roller 123*a* and the first guide roller 124*a* stretch the polishing pad 141 over the top-panel 111 to hold the polishing pad 141 stationary during operation. A motor (not shown) drives the take-up roller 127 and can also drive the supply roller 121 to sequentially advance the polishing pad 141 across the top-panel 111. Accordingly, clean pre-operative sections of the polishing pad 141 may be quickly substituted for worn sections to provide a consistent surface for planarizing and/or cleaning the substrate 112.

The planarizing machine 100 also has a carrier assembly 130 to translate the substrate 112 across the polishing pad 141. In one embodiment, the carrier assembly 130 has a substrate holder 131 to pick up, hold and release the substrate 112 at appropriate stages of the planarizing and finishing cycles. The carrier assembly 130 can include a retainer ring 132 disposed around the substrate 112 to further control the motion of the substrate 112. Alternatively, the retainer ring 132 can be eliminated. In either embodiment, the carrier assembly 130 can also have a support gantry 135 carrying a drive assembly 134 that translates along the gantry 135. The drive assembly 134 generally has an actuator 136, a drive shaft 137 coupled to the actuator 136, and an arm 138 projecting from the drive shaft 137. The arm 138 carries the substrate holder 131 via a terminal shaft 139. In another embodiment, the drive assembly 135 can also have another actuator (not shown) to rotate the terminal shaft 139 and the substrate holder 131 about an axis C—C as the actuator 136 orbits the substrate holder 131 about the axis B—B. One suitable planarizing machine with a carrier assembly and without the polishing pad 141 and the planarizing liquid 143 is manufactured by Obsidian Incorporated of Fremont, Calif. In light of the embodiments of the planarizing machine 100 described above, a specific embodiment of the polishing pad 141 and the planarizing liquid 143 will now be described in more detail.

Figure 3:
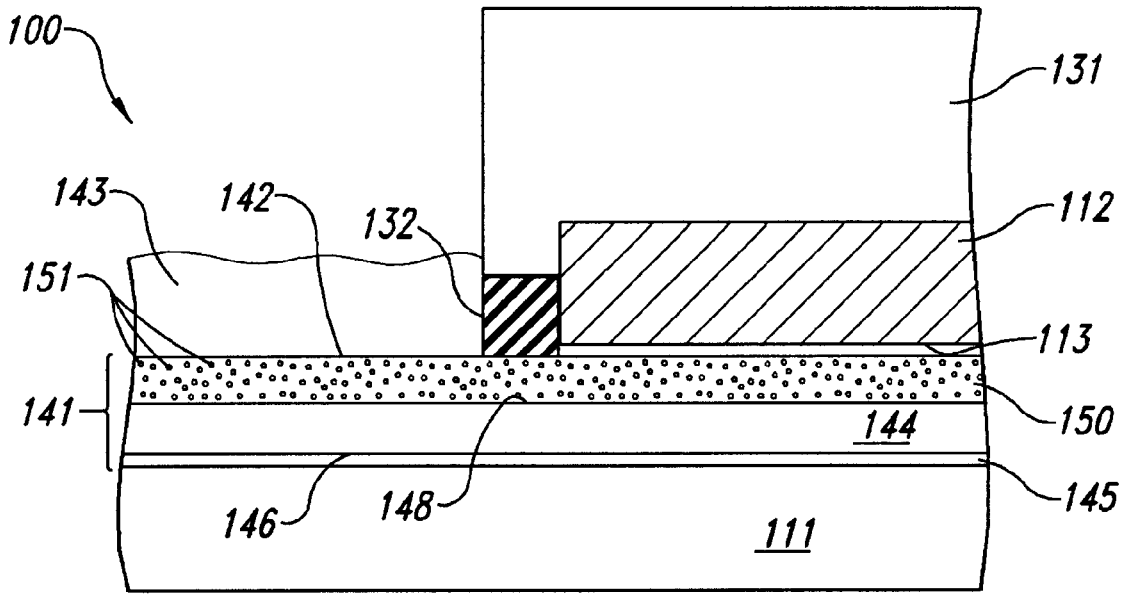
FIG. 3 is a detailed, partially schematic, partial cross-sectional side elevation view of a portion of the planarizing machine and the polishing pad shown in FIG. 2.

FIG. 3 is a detailed, partially schematic cross-sectional side elevation view of a portion of the planarizing machine 100, the polishing pad 141 and the substrate 112 shown in FIG. 2. The substrate 112 is supported by the substrate holder 131 in an inverted position over the polishing pad 141 with a contact surface 113 of the substrate 112 in contact with the planarizing liquid 143 and the polishing pad 141. In the embodiment shown in FIG. 3, the polishing pad 141 has a backing film 145, a body 144 attached to the backing film 145, and a suspension medium 150 attached to the body 144. The backing film 145 is generally a flexible sheet that can wrap around the rollers of the planarizing machine 100. The backing film 145 also generally has a high tensile strength to withstand the tensile forces exerted on the polishing pad 141 as an operative section of the polishing pad 141 is stretched over the top-panel 111. One suitable material for the backing film 145 is Mylar®, manufactured by Du Pont de Nemours of Wilmington, Del.

The body 144 of the polishing pad 141 has a backing surface 146 and a front surface 148 opposite the backing surface 146. The backing surface 146 is configured to be attached to the backing film 145, and the front surface 148 is preferably a highly planar surface facing away from the top-panel 111 to provide an interface surface for the suspension medium 150. The body 144 is generally composed of a continuous phase matrix material, such as polyurethane, or other suitable polishing pad materials. In general, the body 144 is designed to provide the polishing pad 141 with a selected level of compressibility/rigidity. Alternatively, the body 144 can be eliminated and the suspension medium 150 can be attached directly to the backing film 145.

The suspension medium 150 has a planarizing surface 142 facing opposite the backing film 145. In one embodiment, the planarizing surface 142 can be generally flat and in another embodiment, the planarizing surface 142 can be textured to improve its performance. In either case, the suspension medium 150 can include a plurality of abrasive elements 151 distributed throughout the suspension medium 150 and adjacent the planarizing surface 142 for removing material from the substrate 112. Accordingly, the suspension medium 150 can include a binder material, such as an organic resin typically used for fixed abrasive polishing pads. Alternatively, the suspension medium 150 can include other materials that fixedly retain the abrasive elements 151.

The abrasive elements 151 can have a variety of shapes, sizes, compositions and distributions, so long as they effectively planarize the substrate 112. For example, the abrasive elements 151 can be spherical and can include a relatively hard substance, such as ceria. The abrasive elements 151 can be uniformly distributed throughout the suspension medium 150, or alternatively, the abrasive elements 151 can be concentrated in selected regions of the suspension medium 150 to locally increase the polishing rate of the polishing pad 141.

The planarizing liquid 143 adjacent the polishing pad 141 can include a chemical composition that promotes the removal of material from the substrate 112. For example, in one embodiment, the planarizing liquid 143 can include water and a base, such as ammonium hydroxide ($NH_4OH$) that hydrolyzes the substrate 112. In one aspect of this embodiment, where the contact surface 113 of the substrate 112 includes silicon dioxide ($SiO_2$), the following reactions occur:

$$SiO_2+2H_2O \rightarrow Si(OH)_4 \quad (1)$$

$$Si(OH)_4+2OH^- \rightarrow Si(OH)_6^{2-} \quad (2)$$

The $Si(OH)_6^{2-}$ produced by the hydrolysis reaction has been found to be softer than the silicon dioxide and can accordingly be more easily removed from the substrate 112. Furthermore, the $Si(OH)_6^{2-}$ has been found to be more likely than the silicon dioxide to dissolve in the planarizing liquid and less likely than the silicon dioxide to stick to the polishing pad 141. Accordingly, it may be advantageous to promote the formation of $Si(OH)_6^{2-}$ by keeping the hydrolysis reaction active for as long as possible during planarization.

As the silicon dioxide is converted to $Si(OH)_6^{2-}$, the hydroxyl ions ($OH^-$) are consumed, potentially reducing the pH of the planarizing liquid 143 and the rate at which the reaction proceeds. Accordingly, in one embodiment of the invention, the planarizing liquid 143 can include a buffering agent which resists the tendency for the pH of the planarizing liquid 143 to decrease as the reaction proceeds. In one aspect of this embodiment, the buffering agent is capable of maintaining the pH of the planarizing liquid 143 at an approximately constant value greater than 7. In a further aspect of this embodiment, the approximately constant pH value can be in the range of approximately 9 to approximately 13. The buffering agent can include a base, such as ammonium hydroxide or potassium hydroxide, in combination with a salt of a weak acid, such as ammonium acetate, ammonium phosphate, potassium hydrogen phthalate or ammonium citrate. Alternatively, the buffering agent can include other salt/base combinations or other compositions that can maintain the pH of the planarizing liquid at the desired alkaline level.

In one embodiment, the planarizing liquid 143 can be initially disposed on the polishing pad 141 and supplemented with additional amounts of the buffering agent during planarization. In another embodiment, the initial volume of planarizing liquid 143 is not supplemented with additional amounts of the buffering agent. In either case, the buffering agent can be uniformly distributed throughout the planarizing liquid 143 and across the contact surface 113 of the substrate 112.

One feature of an embodiment of the invention described above with reference to FIG. 3 is that the buffered planarizing liquid 143 can maintain its pH at an approximately constant level as the substrate 112 is planarized. Accordingly, the material at the contact surface 113 of the substrate 112 can soften and be removed more easily. The material at the contact surface 113 can include $SiO_2$, as discussed above, or other oxides, and can be doped, for example with tetraethylorthosilicate or borophosphate silicon glass. Alternatively, the material at the contact surface 113 can include silicon nitride. In any of these embodiments, once removed, the material from the substrate 112 can more easily dissolve in the planarizing liquid 143 and be less likely to scratch the substrate 112, which can damage existing features in the substrate 112 or disturb the foundation for formation of additional features.

Another feature is that material removed from the polishing pad 141 can be softened when exposed to the buffered planarizing liquid 143 and therefore be less likely to scratch the substrate 112. For example, the abrasive elements 151 of the polishing pad 141 may include ceria which, if it is eroded from the polishing pad in the form of small particulates, can scratch the substrate 112. By buffering the planarizing liquid 143, the planarizing liquid 143 can remain sufficiently alkaline to soften the ceria particulates, reducing the likelihood that they will scratch the substrate 112.

Still another feature is that the buffering agent is provided external to the polishing pad 141. Accordingly, the amount of buffering agent disposed in the planarizing liquid 143 can be easily adjusted or can be maintained at a constant level. In either case, the amount of buffering agent can be independent of the rate at which the polishing pad 141 wears. This is unlike some existing arrangements where the buffering agent is initially internal to the polishing pad and the release rate of the buffering agent depends on the rate at which the polishing pad wears during planarization.

In another embodiment of the invention, the pH of the planarizing liquid 143 can be maintained at an approximately constant level by initially establishing the pH at a relatively high level. For example, the pH can be selected to be at least about 12. In one aspect of this embodiment, the planarizing liquid 143 can include at least 10% (by weight) ammonia. The remaining 90% of the planarizing liquid 143 can include water and other compounds such that the pH of the planarizing liquid 143 is approximately 12.2. In other embodiments, the pH can be maintained at levels greater than 12.2 by increasing the percentage of ammonia in the planarizing liquid. In still further embodiments, the pH can have other constant values greater than about 12, and/or can include other constituents, such as potassium hydroxide or ethylene diamine. An advantage of the high pH planarizing liquid 143 is that the pH is less likely to decrease as the hydrolysis reaction proceeds, resulting in a longer period of time during which the contact surface 113 of the substrate 112 can be softened and removed with a reduced tendency for scratching. Another advantage is that the high pH liquid can increase the wetted surface area of the polishing pad 141, as described in greater detail below.

In yet another embodiment of the invention, the constituents of the planarizing liquid 143 can be selected to increase the wetted area (or reduce the number of dry spots) of the planarizing surface 142 of the polishing pad 144. For example, in one embodiment, the wetted area can be increased by adding isopropyl alcohol to the planarizing liquid 143. In one aspect of this embodiment, the planarizing liquid 143 can include between about 2% and about 20% isopropyl alcohol and in a further aspect of this embodiment, the planarizing liquid 143 can include about 5% isopropyl alcohol. In another embodiment (described in greater detail below), the planarizing liquid 143 can include a lower concentration of isopropyl alcohol, (or the planarizing liquid 143 can include another surfactant) to reduce friction between the substrate 112 and the polishing pad 141, without significantly increasing the polishing rate. In still another embodiment, the planarizing liquid can include up to about 1% ammonium acetate. In still further embodiments, the planarizing liquid can include other concentrations or constituents, such as polyoxy ethylene ether or a high pH liquid (as described above), that increase the wetted area of the planarizing surface 142 of the polishing pad 141 while remaining compatible with the high pH environment in which the oxide CMP process proceeds. An advantage of the arrangements described above is that the more uniformly wetted planarizing surface 142 has fewer dry spots than it would during some conventional processes, which can reduce the likelihood for scratching the substrate 112 by balancing the chemical and mechanical interactions at the contact surface 113 of the substrate 112. A further advantage of the arrangements described above is that the substrate 112 may be less likely to disengage from the substrate holder 131 during planarization (i.e., "slip out" from the substrate holder 131) when the planarizing surface is more uniformly wetted. Yet a further advantage of the arrangements described above is that the planarization results for multiple substrates 112 may be more consistent because the planarizing surface 142 is more uniformly wetted and/or because the planarizing surface 142 may wear at a slower rate than conventional planarizing surfaces.

In still another embodiment of the invention, the constituents of the planarizing liquid 143 can be selected to control the frictional forces between the contact surface 113 of the substrate 112, and the planarizing surface 142 of the polishing pad 141 as they move relative to each other. The frictional (or drag) forces oppose this relative motion. For example, in one aspect of this embodiment, the planarizing liquid 143 includes a surfactant that reduces the friction between the substrate 112 and the polishing pad 141 at least 40% by reducing the surface tension of the planarizing liquid 143 on the polishing pad 141. In a further aspect of this embodiment, the amount and chemical composition of the surfactant is selected to have a controlled impact on the polishing rate of the planarizing liquid 143. For example, the planarizing liquid 143 can include a surfactant that reduces the polishing rate of the planarizing liquid 143 by about five percent or less compared to a planarizing liquid that does not include the surfactant. In another embodiment, the planarizing liquid can include one or more friction-reducing agents in an amount that decreases the polishing rate by more than five percent, but such planarizing liquids are less desirable because they can substantially decrease the throughput of substrates 112.

In one embodiment, the planarizing liquid 143 can include an alcohol, such as a primary alcohol (having $OH^-$ groups bonded to a carbon atom that is attached to two hydrogen atoms), a secondary alcohol (having $OH^-$ groups bonded to a carbon atom attached to a single hydrogen atom) or a tertiary alcohol (having $OH^-$ groups bonded to a carbon atom attached to no hydrogen atoms). A suitable primary alcohol is propanol, a suitable secondary alcohol is isopropyl alcohol, and a suitable tertiary alcohol is tertiary butyl alcohol. In other embodiments, the planarizing liquid 143 can include other surfactants, such as alkyl (polyethyleneoxypropyleneoxy)isopropanol, available from Union Carbide of Danbury, Conn. under the tradename Tergitol Minfoam 2X. In any of the immediately foregoing embodiments, the surfactant is selected to be a non-foaming surfactant that reduces the likelihood for forming dry spots on the planarizing pad 141. As described above, dry spots can increase the likelihood for scratching the substrate 112, causing slip out, and/or reducing planarization consistency among multiple substrates 112.

When isopropyl alcohol is selected as the friction-reducing agent, the planarizing liquid 143 can include from about 0.5% to about 2.0% isopropyl alcohol, by weight. Planarizing liquids having isopropyl alcohol concentrations within this range have a polishing rate that is decreased by about 5% or less compared to a similar planarizing liquid without the isopropyl alcohol under similar planarizing conditions (e.g., similar temperature, pH, substrate material, relative velocity between the substrate 112 and the polishing pad 141, and normal force applied to the substrate 112). The planarizing liquid 143 can also include water and/or ammonia. Accordingly, the planarizing liquid 143 can include from about 0.5% to about 20% ammonia by weight, about 78% to about 99% water by weight and about 0.5% to about 2% isopropyl alcohol by weight. In one particular embodiment, the planarizing liquid includes about 1.25% isopropyl alcohol by weight, about 10% ammonia by weight and about 88.75% water by weight. The planarizing liquid 143 can also include one or more of the buffering agents (described above), whether the friction-reducing agent is selected to include isopropyl alcohol or another compound.

In yet a further aspect of an embodiment of the invention, the friction-reducing agent in the planarizing liquid 143 can be selected on the basis of the composition of the substrate 112. For example, when the substrate 112 includes an oxide, such as silicon dioxide, the planarizing liquid 143 does not generally include a tertiary alcohol as the friction-reducing agent because tertiary alcohols can decrease the hydrolysis reaction at the contact surface 113 and/or decrease the rate at which the oxide is softened. Both effects can significantly increase the polishing rate, for example, beyond the five percent increase described above. However, tertiary alcohols can be used as the friction-reducing agent in other planarizing operations that do not include a hydrolysis reaction at the contact surface 113. For example, when the contact surface 113 is primarily a metal (such as copper or tungsten), a tertiary alcohol can reduce the friction between the contact surface 113 and the polishing pad 141 without decreasing the polishing rate by more than about five percent. In other embodiments, the planarizing liquid 143 can include other surfactants or friction-reducing agents that have a limited effect on the chemical reaction (typically oxidation or etching) at the contact surface 113 of the substrate 112. Accordingly, these other planarizing liquids can also reduce the friction between the substrate 112 and the polishing pad 141, without decreasing the polishing rate by more than about five percent.

When the planarizing liquid 143 is selected to remove an oxide from the contact surface 113 of the substrate 112, the pH of the planarizing liquid 143 can be controlled to be from approximately 9 to approximately 13. In a further aspect of this embodiment, the pH of the planarizing liquid 143 can be controlled to be at least approximately 12, as described above. When the planarizing liquid 143 includes from about 0.5% to about 20% ammonia, the pH can range from about 10 to about 12.5 , respectively. Alternatively, when the planarizing liquid 143 is selected to remove metal from the content surface 113 of the substrate 112, the pH of the planarizing liquid can be selected to have other pHs ranging from highly acidic to highly alkaline.

Figure 1:
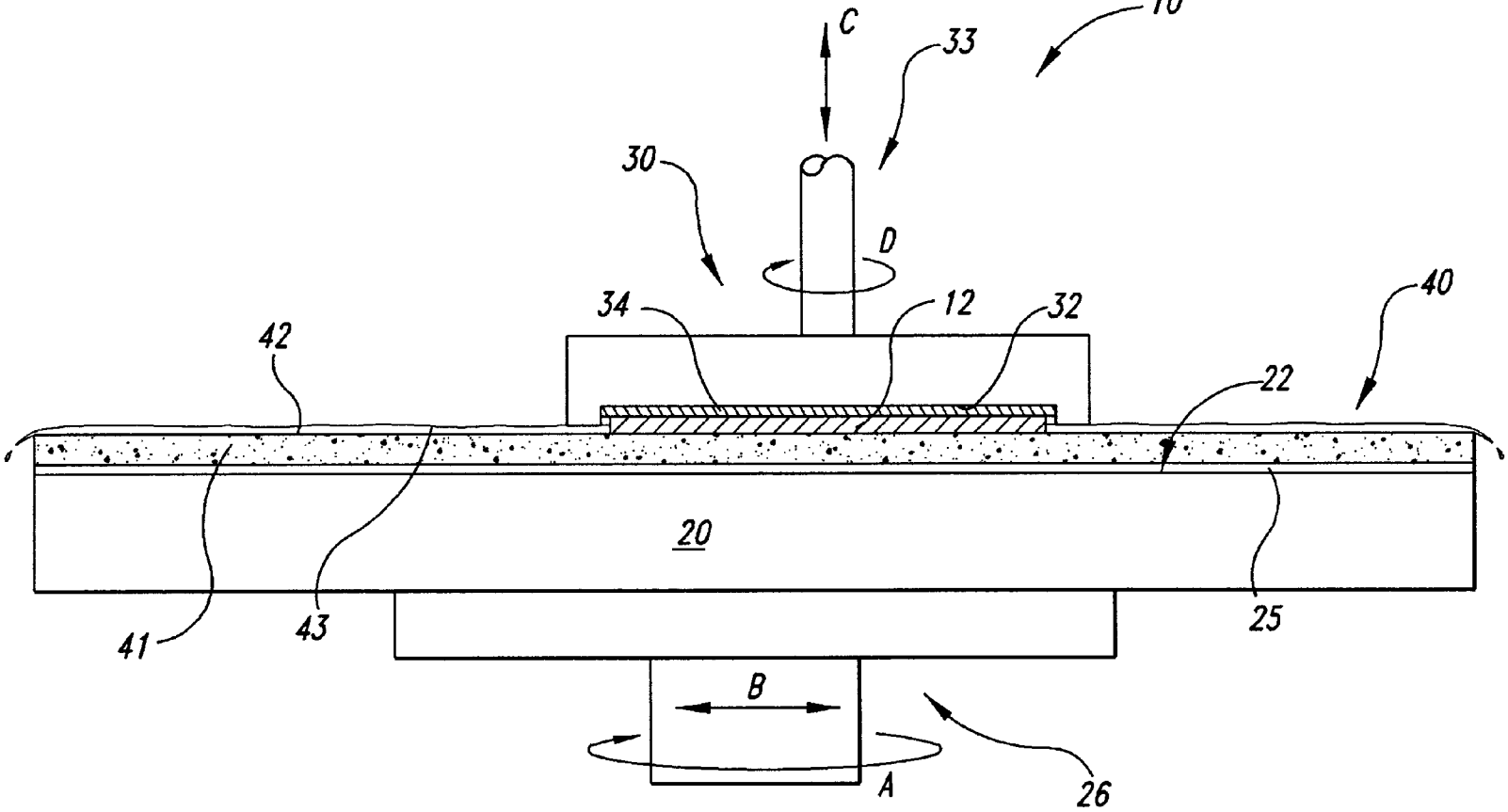
Fig. 1 (Prior Art)
FIG. 1 is a partially schematic, partial cross-sectional side elevation view of a planarizing machine in accordance with the prior art.

From the foregoing, it will be appreciated that, although specific embodiments of the invention have been described herein for purposes of illustration, various modifications may be made without deviating from the spirit and scope of the invention. For example, although the embodiments of the polishing pad 141 illustrated in FIG. 2 include a backing film 145, other polishing pads in accordance with other embodiments of the invention do not include a backing film. The embodiments of the polishing pads shown in FIGS. 2 and 3 include the backing film 145 because they are well suited for use with the web-format planarizing machine 100 shown in FIG. 2. Other embodiments of the polishing pads having a generally circular planform shape without the backing film 145 are generally suitable for use with rotating platen planarizing machines similar to the planarizing machine 10 shown in FIG. 1. Furthermore, the methods and apparatuses described above with reference to FIGS. 2 and 3 can be used in connection with oxide CMP processes, such as shallow trench isolation. Alternatively, the methods and apparatuses can be used with other CMP processes that are typically conducted in an alkaline environment. Accordingly, the invention is not limited except as by the appended claims.

What is claimed is:

1. A method for planarizing a microelectronic substrate, comprising:

engaging the microelectronic substrate with a planarizing liquid and with a fixed abrasive polishing pad having a plurality of abrasive elements fixedly dispersed therein;

moving at least one of the microelectronic substrate and the polishing pad relative to the other of the microelectronic substrate and the polishing pad to remove material from the microelectronic substrate; and buffering the planarizing liquid to maintain the planarizing liquid at an approximately constant pH by providing a buffering agent to only a region external to the polishing pad while engaging the microelectronic substrate with the planarizing liquid.

2. The method of claim 1 wherein buffering the planarizing liquid includes selecting the planarizing liquid to include ammonium hydroxide or potassium hydroxide and at least one of ammonium acetate, ammonium citrate and potassium hydrogen phthalate.

3. The method of claim 1 further comprising selecting the microelectronic substrate to include tetraethylorthosilicate and/or borophosphate silicon glass.

4. The method of claim 1 wherein buffering the planarizing liquid includes maintaining the pH of the planarizing medium to be at an approximately constant value between approximately 9 and approximately 13.

5. The method of claim 1 wherein removing material from the microelectronic substrate includes removing an oxide from the microelectronic substrate.

6. The method of claim 1 wherein removing material from the microelectronic substrate includes removing silicon dioxide from the microelectronic substrate.

7. The method of claim 1 wherein buffering the planarizing liquid includes resisting a decrease in the pH of the planarizing liquid when the material is removed from the microelectronic substrate.

8. The method of claim 1 wherein moving at least one of the microelectronic substrate and the polishing pad includes removing polishing pad material from the polishing pad, further wherein buffering the planarizing liquid includes maintaining the planarizing liquid at an approximately constant pH while the polishing pad material is removed from the polishing pad.

9. The method of claim 1 wherein moving at least one of the microelectronic substrate and the polishing pad includes rotating the polishing pad relative to the microelectronic substrate.

10. The method of claim 1 wherein moving at least one of the microelectronic substrate and the polishing pad includes translating the polishing pad relative to the microelectronic substrate.

11. The method of claim 1, further comprising controlling a drag force on the microelectronic substrate by selecting the planarizing liquid to include a surfactant.

12. A method for planarizing a microelectronic substrate, comprising:

engaging a surface of the microelectronic substrate with a planarizing liquid and with a fixed abrasive polishing pad having abrasive elements fixedly dispersed therein;

moving at least one of the microelectronic substrate and the polishing pad relative to the other of the microelectronic substrate and the polishing pad to remove material from the microelectronic substrate; and controlling a hydrolysis reaction at the surface of the microelectronic substrate by providing a buffering agent to the planarizing liquid while the microelectronic substrate is engaged with the planarizing liquid.

13. The method of claim 12 wherein controlling the hydrolysis reaction includes providing the buffering agent to only a region external to the polishing pad.

14. The method of claim 12 wherein controlling a hydrolysis reaction includes promoting a conversion of silicon dioxide to $Si(OH)_6^{2-}$.

15. The method of claim 12 wherein engaging a surface of the microelectronic substrate with the planarizing liquid and controlling a hydrolysis reaction by buffering the planarizing liquid includes increasing a rate of hydrolysis relative to a hydrolysis rate at an interface between the microelectronic substrate and a non-buffered planarizing liquid.

16. The method of claim 12, further comprising maintaining the pH of the planarizing liquid to be at an approximately constant value between approximately 9 and approximately 13.

17. A method for planarizing a microelectronic substrate, comprising:

engaging a surface of the microelectronic substrate with a planarizing liquid and with a fixed abrasive polishing pad having abrasive elements fixedly dispersed therein;

moving at least one of the microelectronic substrate and the polishing pad relative to the other of the microelectronic substrate and the polishing pad to remove material from the microelectronic substrate; and maintaining a pH of the planarizing liquid at an approximately constant value between approximately 9 and approximately 13 by buffering the planarizing liquid while the material is removed from the microelectronic substrate.

18. The method of claim 17 wherein maintaining a pH of the planarizing liquid includes selecting the planarizing liquid to include ammonium hydroxide or potassium hydroxide and at least one of ammonium acetate, ammonium citrate, and potassium hydrogen phthalate.

19. The method of claim 17 wherein maintaining a pH of the planarizing liquid includes adding to the planarizing liquid a chemical buffering agent that includes an acid and a salt.

20. The method of claim 17 wherein maintaining the pH of the planarizing liquid includes increasing a wetted surface area of a planarizing surface of the polishing pad relative to the planarizing surface of a polishing pad engaged with a planarizing liquid having a pH less than approximately 9 or greater than approximately 13.

21. The method of claim 17 wherein moving at least one of the microelectronic substrate and the polishing pad includes removing polishing pad material from the polishing pad, further wherein maintaining a pH of the planarizing liquid includes maintaining the planarizing liquid at an approximately constant pH while the polishing pad material is removed from the polishing pad.

22. A method for planarizing a microelectronic substrate, comprising:

engaging a surface of the microelectronic substrate with a planarizing liquid and with a fixed abrasive polishing pad having a plurality of abrasive elements fixedly dispersed therein;

moving at least one of the microelectronic substrate and the polishing pad relative to the other to remove material from the microelectronic substrate; and controlling a rate at which scratches are formed in the surface of the microelectronic substrate by chemically buffering the planarizing liquid with a buffering agent while the microelectronic substrate is engaged with the planarizing liquid.

23. The method of claim 22 wherein controlling a rate at which scratches are formed includes reducing a rate at which scratches are formed relative to a rate at which scratches are formed when the microelectronic substrate is engaged with a non-buffered planarizing liquid.

24. The method of claim 22 wherein controlling a rate at which scratches are formed includes softening the surface of the microelectronic substrate.

25. The method of claim 22 wherein controlling the rate at which scratches are formed includes providing a chemical buffering agent to only a region external to the polishing pad.

26. The method of claim 22 wherein moving at least one of the microelectronic substrate and the polishing pad includes removing polishing pad material from the polishing pad and controlling a rate at which scratches are formed includes softening the polishing pad material removed from the polishing pad.

27. The method of claim 22 wherein controlling a rate at which scratches are formed includes selecting the planarizing liquid to include ammonium hydroxide and at least one of ammonium acetate, ammonium citrate, and potassium hydrogen phthalate.

28. The method of claim 22 wherein controlling the rate at which scratches are formed includes maintaining the pH of the planarizing liquid to be at an approximately constant value between approximately 9 and approximately 13.

29. A method for planarizing a microelectronic substrate, comprising:

selecting a planarizing liquid to have a pH of at least approximately 12;

engaging the microelectronic substrate with the planarizing liquid and with a fixed abrasive polishing pad having a plurality of fixed abrasive elements dispersed therein; and moving at least one of the microelectronic substrate and the polishing pad relative to the other to remove material from the microelectronic substrate.

30. The method of claim 29 wherein selecting the planarizing liquid includes selecting the planarizing liquid to include at least one of ammonia, potassium hydroxide and ethylene diamine.

31. The method of claim 29 wherein selecting the planarizing liquid includes selecting the planarizing liquid to include at least approximately 10% by weight ammonia.

32. The method of claim 29 wherein moving at least one of the microelectronic substrate and the polishing pad includes removing polishing pad material from the polishing pad, further comprising maintaining the planarizing liquid at an approximately constant pH while the polishing pad material is removed from the polishing pad.

33. A method for planarizing a microelectronic substrate, comprising:

engaging the microelectronic substrate with a planarizing liquid having a pH in the range of approximately 9 to approximately 13 and with a fixed abrasive polishing pad having a plurality of fixed abrasive elements dispersed therein;

moving at least one of the microelectronic substrate and the polishing pad relative to the other to remove material from the microelectronic substrate; and controlling an amount of wetted surface area of the polishing pad by selecting the planarizing liquid to include at least one of isopropyl alcohol, ammonium acetate and polyoxy ethylene ether.

34. The method of claim 33 wherein engaging the microelectronic substrate and controlling an amount of wetted surface area includes increasing the amount of wetted surface area relative to a microelectronic substrate engaged with a planarizing liquid that does not include at least one of isopropyl alcohol, ammonium acetate and polyoxy ethylene ether.

35. The method of claim 33 wherein selecting the planarizing liquid includes selecting the planarizing liquid to include up to approximately 10% ammonium acetate.

36. The method of claim 33 wherein removing material from the microelectronic substrate includes removing an oxide from the microelectronic substrate.

37. The method of claim 33 wherein selecting the planarizing liquid includes selecting the planarizing liquid to include between approximately 2% and approximately 20% isopropyl alcohol.

38. A method for planarizing a microelectronic substrate, comprising:

engaging a surface of the microelectronic substrate with a planarizing liquid and with a fixed abrasive polishing pad having a plurality of abrasive elements fixedly dispersed therein;

moving at least one of the microelectronic substrate and the polishing pad relative to the other to remove an oxide material from the microelectronic substrate; and buffering the planarizing liquid to maintain the planarizing liquid at an approximately constant pH in the range of between approximately 9 and approximately 13.

39. The method of claim 38 wherein buffering the planarizing liquid includes selecting the planarizing liquid to include ammonium hydroxide and at least one of ammonium acetate, ammonium citrate and potassium hydrogen phthalate.

40. The method of claim 38 wherein moving at least one of the microelectronic substrate and the polishing pad includes translating the polishing pad relative to the microelectronic substrate.

41. A method for removing material from a microelectronic substrate, comprising:

engaging the microelectronic substrate with a planarizing liquid including a surfactant and with a fixed abrasive polishing pad having a plurality of fixed abrasive elements dispersed therein;

moving at least one of the microelectronic substrate and the polishing pad relative to the other to remove material from the microelectronic substrate; and controlling a drag force on the microelectronic substrate by selecting the surfactant and a concentration thereof in the planarizing liquid to achieve a desired surface tension of the planarizing liquid while promoting a hydrolysis reaction at a surface of the microelectronic substrate.

42. The method of claim 41 wherein the microelectronic substrate has a generally flat surface that includes an oxide, further comprising:

removing material from all portions of the surface of the microelectronic substrate at a generally uniform rate; and selecting the surfactant to include isopropyl alcohol, with the isopropyl alcohol forming from about 0.5% to about 2% of the weight of the planarizing liquid.

43. The method of claim 41 wherein the planarizing liquid is a first planarizing liquid, further comprising selecting an amount of the surfactant in the first planarizing liquid to reduce a first polishing rate of the first planarizing liquid by no more than about 5% compared to a second polishing rate of a second planarizing liquid not having the surfactant, when the first and second planarizing liquids remove material under generally identical conditions.

44. The method of claim 41 wherein engaging the microelectronic substrate includes engaging an oxide portion of the microelectronic substrate.

45. The method of claim 41, further comprising controlling a pH of the planarizing liquid to be at least approximately 12.

46. The method of claim 41, further comprising controlling a pH of the planarizing liquid to be from approximately 9 to approximately 13.

47. The method of claim 41, further comprising selecting the planarizing liquid to include a primary alcohol, a secondary alcohol and/or a tertiary alcohol.

48. The method of claim 41, further comprising selecting the planarizing liquid to include a generally non-foaming surfactant.

49. The method of claim 41, further comprising selecting the planarizing liquid to include from approximately 0.5% to approximately 2.0% isopropyl alcohol by weight.

50. The method of claim 41, further comprising selecting the planarizing liquid to include from about 0.5% to about 20.0% ammonia by weight.

51. The method of claim 41, further comprising removing metal material from the microelectronic substrate.

52. The method of claim 41, further comprising buffering the planarizing liquid to maintain the planarizing liquid at an approximately constant pH by selecting the planarizing liquid to include a buffering agent.

53. A method for removing material from a microelectronic substrate, comprising:

engaging the microelectronic substrate with a planarizing medium having a planarizing liquid with a surfactant, the planarizing medium further having a fixed abrasive polishing pad with a plurality of fixed abrasive elements dispersed therein;

moving at least one of the microelectronic substrate and the planarizing medium relative to the other to remove material from the microelectronic substrate; and controlling a drag force imparted to the microelectronic substrate by the planarizing medium to be less than another drag force imparted to the microelectronic substrate by another planarizing medium having another planarizing liquid that does not include the surfactant, with the planarizing liquid having a polishing rate that is not more than approximately 5% less than a polishing rate of the other planarizing liquid at approximately identical planarizing conditions.

54. The method of claim 53 wherein the planarizing conditions include a pH of the first planarizing liquid, a relative rate of movement between the microelectronic substrate and the planarizing medium, and a normal force between the microelectronic substrate and the planarizing medium.

55. The method of claim 53, further comprising controlling a pH of the planarizing liquid to be from approximately 9 to approximately 13.

56. The method of claim 53, further comprising selecting the planarizing liquid to include from approximately 0.5% to approximately 2.0% isopropyl alcohol by weight.

57. The method of claim 53 wherein the microelectronic substrate has a generally flat surface and removing material includes removing material from all portions of the surface of the microelectronic substrate at a generally uniform rate.

58. A method for removing material from a microelectronic substrate, comprising;

engaging the microelectronic substrate with a planarizing liquid and with a fixed abrasive polishing pad having a plurality of fixed abrasive elements dispersed therein;

moving at least one of the microelectronic substrate and the polishing pad relative to the other to remove material from the microelectronic substrate; and controlling a drag force between the microelectronic substrate and the polishing pad by selecting the planarizing liquid to include isopropyl alcohol.

59. The method of claim 58 wherein the planarizing liquid is a first planarizing liquid, further comprising selecting an amount of the isopropyl alcohol in the first planarizing liquid to reduce a first polishing rate of the first planarizing liquid by no more than about 5% compared to a second polishing rate of a second planarizing liquid not having isopropyl alcohol, when the first and second planarizing liquids remove material under generally identical conditions.

60. The method of claim 58 wherein engaging the microelectronic substrate includes engaging an oxide portion of the microelectronic substrate.

61. The method of claim 58, further comprising selecting the planarizing liquid to include from approximately 0.5% to approximately 2.0% isopropyl alcohol by weight.

62. The method of claim 58 wherein the microelectronic substrate has a generally flat surface and removing material includes removing material from all portions of the surface of the microelectronic substrate at a generally uniform rate.

63. A method for removing material from a microelectronic substrate, comprising:

engaging the microelectronic substrate with a first planarizing medium having a planarizing liquid and a fixed abrasive polishing pad having a plurality of fixed abrasive elements dispersed therein;

moving at least one of the microelectronic substrate and the first planarizing medium relative to the other to remove material from the microelectronic substrate until a surface of the microelectronic substrate engaged with the first planarizing medium is approximately flat; and controlling a first drag force between the microelectronic substrate and the first planarizing medium to be less than a second drag force between the microelectronic substrate and a second planarizing medium that does not include a surfactant by selecting the planarizing liquid to include the surfactant.

64. The method of claim 63 wherein the planarizing liquid is a first planarizing liquid, further comprising selecting an amount of the surfactant in the first planarizing liquid to reduce a first polishing rate of the first planarizing liquid by no more than about 5% compared to a second polishing rate of a second planarizing liquid not having the surfactant when the first and second planarizing liquids remove material under generally identical conditions.

65. The method of claim 63, further comprising controlling the first frictional force to be at least 40% less than the second frictional force.

66. The method of claim 63 wherein engaging the microelectronic substrate includes engaging an oxide portion of the microelectronic substrate.

67. The method of claim 63, further comprising selecting the planarizing liquid to include from approximately 0.5% to approximately 2.0% isopropyl alcohol by weight.

68. A method for removing material from a microelectronic substrate, comprising:

engaging the microelectronic substrate with a carrier, a first surface of the microelectronic substrate facing toward the carrier and an approximately flat second surface of the microelectronic substrate facing opposite the first surface;

engaging the second surface of the microelectronic substrate with a first planarizing liquid and with a fixed abrasive polishing pad having a plurality of fixed abrasive elements dispersed therein;

controlling a pH of the first planarizing liquid to be from approximately 9 to approximately 13;

moving at least one of the microelectronic substrate and the polishing pad relative to the other to remove material from all portions of the second surface of the microelectronic substrate at a generally uniform rate; and controlling a drag force between the microelectronic substrate and the polishing pad by selecting the first planarizing liquid to include an amount of isopropyl alcohol that reduces a first polishing rate of the first planarizing liquid by no more than about 5% compared to a second polishing rate of a second planarizing liquid not having the isopropyl alcohol, when the first and second planarizing liquids remove material under generally identical conditions.

69. The method of claim 68, further comprising selecting the planarizing liquid to include water and ammonia with water forming from about 88% to about 99% of the planarizing liquid weight, ammonia forming from about 0.5% to about 20.0% of the planarizing liquid weight, and the isopropyl alcohol forming from about 0.5% to about 2.0% of the planarizing liquid weight.

70. A method for removing material from a microelectronic substrate, comprising:

engaging the microelectronic substrate with a first planarizing liquid and with a fixed abrasive polishing pad having a plurality of fixed abrasive elements dispersed therein;

moving at least one of the microelectronic substrate and the polishing pad relative to the other to remove material from the microelectronic substrate; and controlling a removal rate at which material is removed from the microelectronic substrate to be less than a removal rate of a second planarizing liquid that does not include a surfactant by selecting the planarizing liquid to include the surfactant.

71. The method of claim 70 wherein the planarizing liquid is a first planarizing liquid, further comprising selecting an amount of the surfactant in the first planarizing liquid to reduce a first polishing rate of the first planarizing liquid by no more than about 5% compared to a second polishing rate of a second planarizing liquid not having the surfactant when the first and second planarizing liquids remove material under generally identical conditions.

72. The method of claim 70, further comprising controlling a pH of the planarizing liquid to be from approximately 9 to approximately 13.

73. The method of claim 70, further comprising selecting the planarizing liquid to include from approximately 0.5% to approximately 2.0% isopropyl alcohol by weight.

74. The method of claim 70 wherein the microelectronic substrate has a generally flat surface and removing material includes removing material from all portions of the surface of the microelectronic substrate at a generally uniform rate.

75. A planarizing medium for planarizing a microelectronic substrate, comprising:

a fixed abrasive polishing pad having an external surface and a plurality of abrasive elements adjacent to the external surface, the external surface defining an external region external to the polishing pad and an internal region internal to the polishing pad; and a planarizing liquid adjacent to the external surface of the fixed abrasive polishing pad in the external region only, the planarizing liquid having a buffering agent for maintaining a pH of the planarizing liquid at an approximately constant level.

76. The planarizing medium of claim 75 wherein the buffering agent includes ammonium hydroxide and at least one of ammonium acetate, ammonium phosphate, potassium hydrogen phthalate and ammonium citrate.

77. The planarizing medium of claim 75 wherein the abrasive particles include ceria.

78. The planarizing medium of claim 75 wherein a pH of the planarizing liquid has an approximately constant value between approximately 9 and approximately 13.

79. The planarizing medium of claim 75 wherein the polishing pad includes an elongated flexible web configured to be wound from a first roller across a platen to a second roller.

80. The planarizing liquid of claim 75 wherein the planarizing liquid includes a surfactant for reducing friction between the polishing pad and the microelectronic substrate.

81. A planarizing medium for planarizing a microelectronic substrate, comprising:

a fixed abrasive polishing pad having a planarizing surface and a plurality of abrasive elements fixedly dispersed in the polishing pad adjacent the planarizing surface for engaging the microelectronic substrate and removing material from the microelectronic substrate;

a planarizing liquid adjacent to the fixed abrasive polishing pad; and a chemical buffering agent disposed in the planarizing liquid for maintaining a pH of the planarizing liquid at an approximately constant value between approximately 9 and approximately 13.

82. The planarizing medium of claim 81 wherein the buffering agent includes ammonium hydroxide and at least one of ammonium acetate, ammonium phosphate, potassium hydrogen phthalate and ammonium citrate.

83. The planarizing medium of claim 81 wherein the fixed abrasive particles include ceria.

84. The planarizing medium of claim 81 wherein the polishing pad includes an elongated flexible web configured to be wound from a first roller across a platen to a second roller.

85. A planarizing medium for planarizing a microelectronic substrate, comprising:

a fixed abrasive polishing pad having a planarizing surface and a plurality of abrasive elements fixedly dispersed in the polishing pad adjacent the planarizing surface for engaging the microelectronic substrate and removing material from the microelectronic substrate; and a planarizing liquid adjacent to the fixed abrasive polishing pad, the planarizing liquid having a pH of between approximately 9 and approximately 13 and including at least one of ammonium acetate, isopropyl alcohol and polyoxy ethylene ether for controlling a wetted surface area of the microelectronic substrate.

86. The planarizing medium of claim 85 wherein the planarizing liquid includes between approximately 2% and approximately 20% isopropyl alcohol.

87. The planarizing medium of claim 85 wherein the planarizing liquid includes up to approximately 1% ammonium acetate.

88. The planarizing medium of claim 85 wherein the polishing pad includes an elongated flexible web configured to be wound from a first roller across a platen to a second roller.

89. A planarizing medium for planarizing a microelectronic substrate, comprising:

a fixed abrasive polishing pad having a planarizing surface and a plurality of abrasive elements fixedly dispersed in the polishing pad adjacent the planarizing surface for engaging the microelectronic substrate and removing material from the microelectronic substrate; and a planarizing liquid adjacent to the fixed abrasive polishing pad, the planarizing liquid having a pH of at least approximately 12.

90. The apparatus of claim 89 wherein the planarizing liquid includes at least one of ammonia, potassium hydroxide and ethylene diamine.

91. The apparatus of claim 89 wherein the planarizing liquid includes at least approximately 10% by weight ammonia.

92. A planarizing liquid for use with a fixed abrasive polishing pad, the planarizing liquid comprising:

water forming from about 78% to about 99% by weight of the planarizing liquid;

ammonia forming from about 0.5% to about 20.0% by weight of the planarizing liquid; and isopropyl alcohol forming from about 0.5% to about 2.0% by weight of the planarizing liquid.

93. The planarizing liquid of claim 92 wherein the isopropyl alcohol forms about 1.25% by weight of the planarizing liquid, the ammonia forms about 10% by weight of the planarizing liquid and the water forms about 88.75% by weight of the planarizing liquid.

94. The planarizing liquid of claim 92 wherein the isopropyl alcohol reduces a polishing rate of the planarizing liquid by no more than about 5% compared to a polishing rate of another planarizing liquid not having the isopropyl alcohol when both planarizing liquids remove material under generally identical conditions.

95. The planarizing liquid of claim 92, further comprising a buffering agent for maintaining a pH of the planarizing liquid at an approximately constant level.

96. A planarizing medium for removing material from a microelectronic substrate, comprising:

a fixed abrasive polishing pad having a suspension medium and a plurality of abrasive particles fixedly dispersed in the suspension medium; and a planarizing liquid having a planarizing liquid weight with water forming from about 78% to about 99% of the planarizing liquid weight, ammonia forming from about 0.5% to about 20.0% of the planarizing liquid weight, and isopropyl alcohol forming from about 0.5% to about 2.0% of the planarizing liquid weight.

97. The planarizing liquid of claim 96 wherein the isopropyl alcohol reduces a polishing rate of the planarizing liquid by no more than about 5% compared to a polishing rate of another planarizing liquid not having the isopropyl alcohol when both planarizing liquids remove material under generally identical conditions.

98. The planarizing liquid of claim 96 wherein the isopropyl alcohol forms about 1.25% by weight of the planarizing liquid, the ammonia forms about 10% by weight of the planarizing liquid and the water forms about 88.75% by weight of the liquid.

* * * * *

UNITED STATES PATENT AND TRADEMARK OFFICE

CERTIFICATE OF CORRECTION

PATENT NO. : 6,383,934 B1
DATED : May 7, 2002
INVENTOR(S) : Sabde et al.

It is certified that error appears in the above-identified patent and that said Letters Patent is hereby corrected as shown below:

Column 3,
Line 25, "patent application" should be -- Patent Application --;

Column 14,
Lines 58-59, should be -- material from the microelectronic substrate; and controlling a drag force on the microelectronic substrate by --;

Column 16,
Line 9, "comprising;" should be -- comprising: --;

Signed and Sealed this

Sixth Day of May, 2003

JAMES E. ROGAN
*Director of the United States Patent and Trademark Office*